US006552284B1

(12) United States Patent
Drago

(10) Patent No.: US 6,552,284 B1
(45) Date of Patent: Apr. 22, 2003

(54) WATER PUMP LOW PRESSURE CUTOFF SWITCH

(76) Inventor: Derrin T. Drago, P.O. Box 16271, Jacksonville, FL (US) 32245

( * ) Notice: Subject to any disclaimer, the term of this patent is extended or adjusted under 35 U.S.C. 154(b) by 0 days.

(21) Appl. No.: 10/080,391

(22) Filed: Feb. 25, 2002

(51) Int. Cl.[7] ..... H01H 35/40
(52) U.S. Cl. ..... 200/83 R; 200/83
(58) Field of Search ..... 200/83 N, 61.2, 200/83 J, 81 R, 83 R, 83 A, 83 Z, 815, 61.22, 61.25, 61.26

(56) References Cited

U.S. PATENT DOCUMENTS

| | | | | |
|---|---|---|---|---|
| 1,169,305 A | | 1/1916 | Turner | |
| 2,554,266 A | | 5/1951 | Pauly | |
| 2,744,977 A | * | 5/1956 | Lombard et al. | 200/83 J |
| 2,765,743 A | | 10/1956 | Hollinshead | |
| 2,856,481 A | * | 10/1958 | Ernst | 200/83 R |
| 2,990,780 A | | 1/1961 | Kreuter | |
| 3,106,894 A | | 10/1963 | Johnsen | |
| 3,139,493 A | | 6/1964 | Krieger et al. | |
| 3,140,819 A | | 7/1964 | Coyle | |
| 3,141,475 A | | 7/1964 | Guinard et al. | |
| 3,150,684 A | | 9/1964 | Guinard et al. | |
| 3,271,971 A | | 9/1966 | Jensen et al. | |
| 3,274,940 A | | 9/1966 | Cottrell | |
| 3,295,450 A | | 1/1967 | Schonwald et al. | |
| 3,318,247 A | | 5/1967 | Yost | |
| 3,407,277 A | * | 10/1968 | Chapin | 200/83 R |
| 3,433,909 A | * | 3/1969 | Phlieger, Jr. | 200/82 R |
| 3,510,617 A | * | 5/1970 | Mitchell et al. | 200/83 |
| 3,534,329 A | * | 10/1970 | Greene | 340/626 |
| 3,535,480 A | * | 10/1970 | Bahniuk | 200/83 R |
| 3,551,620 A | | 12/1970 | Hoover | |
| 3,637,326 A | | 1/1972 | Dowell | |
| 3,683,137 A | | 8/1972 | Stiltner | |
| 3,694,105 A | | 9/1972 | Martin | |
| 3,794,789 A | | 2/1974 | Bynum | |
| 4,180,374 A | | 12/1979 | Bristow | |
| 4,200,775 A | | 4/1980 | Bodnar | |
| 4,215,254 A | | 7/1980 | Ohki | |
| 5,197,859 A | | 3/1993 | Siff | |
| 5,198,631 A | | 3/1993 | Hogue et al. | |
| 5,524,333 A | | 6/1996 | Hogue et al. | |
| 5,672,049 A | | 9/1997 | Ciurlo | |
| 5,725,359 A | | 3/1998 | Dongo et al. | |
| 6,446,654 B1 | * | 9/2002 | Brazier et al. | 137/68.18 |

FOREIGN PATENT DOCUMENTS

| | | | |
|---|---|---|---|
| EP | 10729 | * | 5/1980 |

* cited by examiner

*Primary Examiner*—Elvin Enad
*Assistant Examiner*—Lisa N. Klaus
(74) *Attorney, Agent, or Firm*—Richard C. Litman

(57) ABSTRACT

A water pump low pressure cutoff switch comprising a cylindrical housing incorporating an upper water chamber and a lower dry chamber. The water chamber is connected to a water line adjacent the pump, and is formed by a movable circular plate having a sealing means and a centered bypass button post on its top surface. The bottom surface of the movable plate has a pair of cylindrical electrical contacts with flat faces. A fixed plate creating the dry chamber has matching aligned electrical contacts which move apart to break the circuit when a calibrated compression coil spring affixed between the plates expands when a predetermined lower water pressure is met.

8 Claims, 1 Drawing Sheet

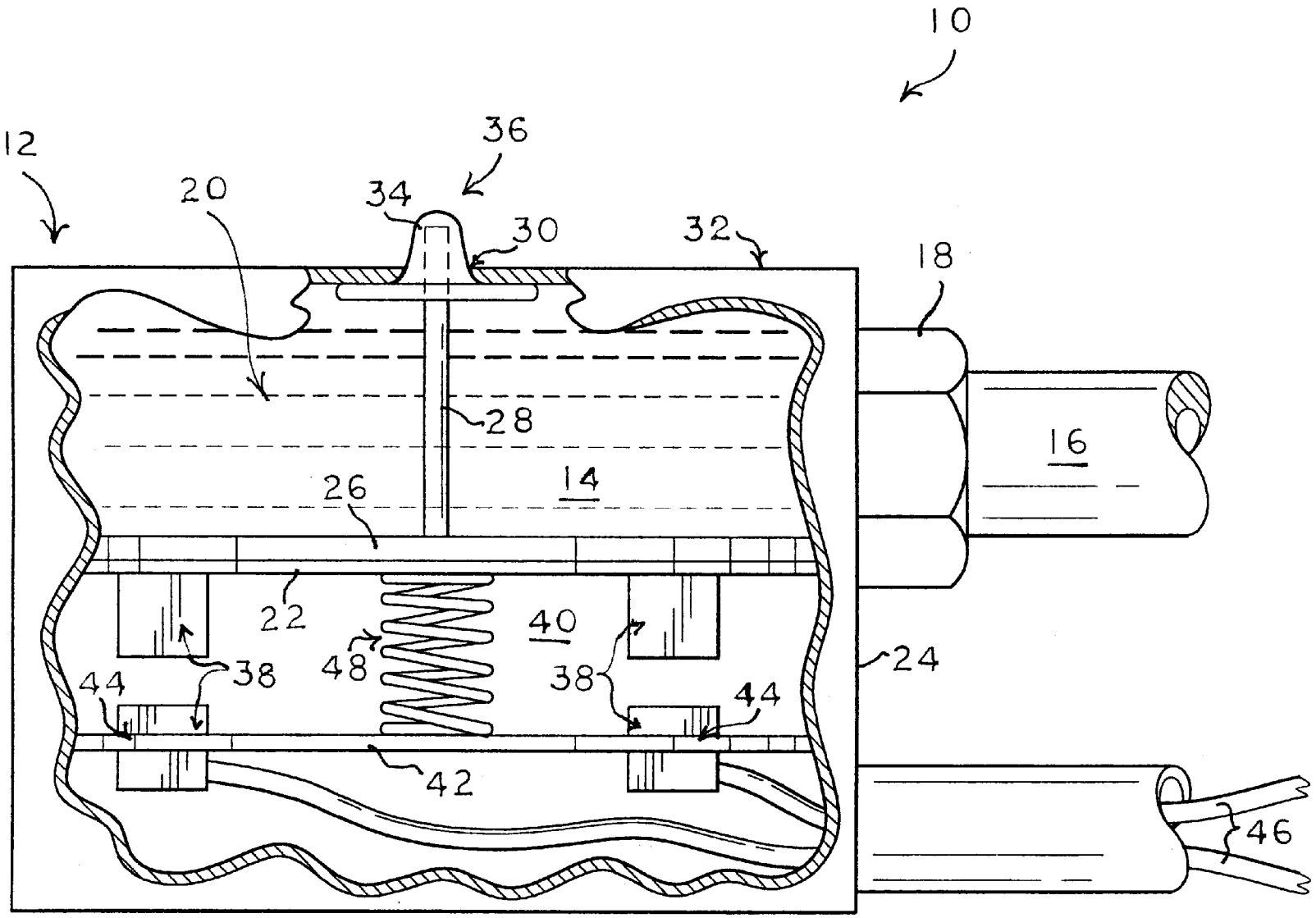
10
12
14
16
18
20
22
24
26
28
30
32
34
36
38
40
42
44
46
48

WATER PUMP LOW PRESSURE CUTOFF SWITCH

BACKGROUND OF THE INVENTION

1. Field of the Invention

The present invention relates generally to water pumps. More specifically, the invention is a low pressure cutoff switch for water pumps.

2. Description of the Related Art

The related art of interest describes various cutoff switches, but none discloses the present invention. There is a need for automatically terminating the operation of a water pump undergoing low pressure to prevent a possible fire and electrical damage to the water pump. The device is simple in construction, and thus economically low in cost to produce. The related art is discussed in the order of perceived relevance to the present invention.

U.S. Pat. No. 4,180,374 issued on Dec. 25, 1979, to Elliott R. Bristow describes a well pump protection system including a timing device, a first ball check valve, a second check valve, and a third pressure pop-off or gate valve. The first valve utilizes a ball acting on a spring supporting a piston with its shaft supporting a bridge contact plate contacting two separated contacts from an overhead position in a separate conduit. The second check valve utilizes a flat valve and a light spring to lower the bridge contact plate to break contact with the two separated contacts positioned above the contact plate. The first and second valves are distinguishable for confining their contacts in separate housings.

U.S. Pat. No. 5,672,049 issued on Sep. 30, 1997, to Ugo Ciurlo describes an electromechanical device inserted in a water pipe by a union for the protection of a pump in waterworks in the absence of water comprising a branch from an outlet of a pump to a cavity partially delimited by a membrane, a moving rod element or piston in a casing pushed by a spring toward the membrane and capable of yielding under limited water pressure to act on the membrane and moving electrical contacts, and interacting with fixed contacts of a pump supply circuit to enable the pump to be switched on, and off in the absence of pressure acting on the membrane. The device is distinguishable for requiring a piston.

U.S. Pat. No. 2,554,266 issued on May 22, 1951, to Jacob L. Pauly describes a pressure actuated switch for use with oxygen demand regulators comprising a cylindrical housing containing a coil compression spring around a vertical sleeve containing a piston having an upper contact pin for contacting a U-shaped leaf spring having a first movable contact bead contacting a second fixed contact bead located on a vertical electric coupling leaving the housing, and air ports on its bottom abutment plate. The piston has an upper adjustment nut above an external coil compression spring held by a cross pin traversing an elongated slot. A round mounting flange has a water influent port externally threaded for connection to a pipe. A water chamber is formed between the mounting flange having an upper abutment plate and a lower resilient bottom diaphragm. When pressure is applied to the chamber, the contacts are engaged. A fall in pressure within the chamber will permit the spring on the piston to return the piston to its neutral or normal position permitting the contacts of the leaf spring and the stationary contact of the upper coupling to disengage to break the electrical circuit. The device operates between 6 to 25 psi water pressure for oxygen demand regulators. The device is distinguishable for requiring a piston and a spring clamp.

U.S. Pat. No. 3,139,493 issued on Jun. 30, 1964, to Irving W. Krieger, Sr. et al describes a pressure switch with a low pressure cut-out comprising a square housing attached to a threaded water outlet and containing a contact block, a frame assembly, and a vertical rod within a coil spring resting on an actuating lever extending outside the housing. A flexible diaphragm is located between the housing and the water outlet pipe connected to a base of a flat spring member. The device is distinguishable for requiring a contact block, an adjustable coil spring, a flat spring member, and an actuating lever.

U.S. Pat. No. 3,637,326 issued on Jan. 25, 1972, to Winston C. Dowell describes a manual control for a pressure-responsive switch of a submersible motor and a pump comprising a manual control for a pressure-responsive switch that activates a pump without regard to the level of liquid in the tank or sump may be below a predetermined value. The device is distinguishable for requiring manual control of a submersible motor and pump.

U.S. Pat. No. 1,169,305 issued on Jan. 25, 1916, to Walter V. Turner describes an electric pump governor comprising a piston, a cut-in and a cut-out valve piston with each having a cut-in and cut-out position, communication through which fluid is admitted to the control piston being established when the cut-in valve piston is in its cut-out position and the cut-out valve in its cut-in position. The device is distinguishable for requiring three pistons.

U.S. Pat. No. 2,765,743 issued on Oct. 9, 1956, to William H. Hollinshead describes a manual switch control for controlling the circuit of a pump having a resilient impeller. The device is arranged so that when the suction line of the water pump is broken or draws air rather than water, the circuit to the motor will open and the motor will stop with a manual on/off lever in a square casing containing also a pair of fixed contact points and a movable pair of contact points on a plate moved by the lever to break the electrical contact by separation of the contact points. The device is distinguishable for its manual control.

U.S. Pat. No. 2,990,780 issued on Jul. 4, 1961, to Kenneth G. Kreuter describes a water valve for a well pump inserted in the water pipe line comprising upper and lower chambers separated by a wall having a valve element closing the wall opening via a spring on the valve element's shaft. A cam on a rotatable shaft which traverses the pipe acts a stop. The device is distinguishable for its non-electrical control.

U.S. Pat. No. 3,106,894 issued on Oct. 15, 1963, to Odd F. Johnsen describes a pressure operated reduction valve for water supply systems comprising a double acting valve with a primary valve and a secondary valve arranged in parallel and operated by the pressure in a pressure bell. A diaphragm located between the pressure medium in the pressure bell and a chamber kept at water outlet pressure controls the regulating valve. A part of the diaphragm forms the valve seat of the secondary. The valve body is combined with the valve body of the primary valve. A range switch is controlled by the pressure in the pressure bell, and will work in a range determined by the working pressure setting at any time, which pressure in turn controls the regulating valve. The system is distinguishable for requiring a range switch.

U.S. Pat. No. 3,140,819 issued on Jul. 14, 1964, to Joseph E. Coyle describes a vacuum cut-off switch for detecting large leaks in a vacuum system and responding by cutting off the current flow to the vacuum pump motor. The device is distinguishable for its mechanism being responsive to a large leak in a vacuum system.

U.S. Pat. No. 3,141,475 issued on Jul. 21, 1964, and U.S. Pat. No. 3,150,684 to Paul A. Guinard et al. describes a regulating valve for a motorpump controlled by a pressure responsive switch.

U.S. Pat. No. 3,271,971 issued on Sep. 13, 1966, to Erik H. Jensen et al. describes low pressure cut-outs for refrigerant compressors.

U.S. Pat. No. 3,274,940 issued on Sep. 27, 1966, to Robert A. Cottrell describes a pressure control system for the prevention of gas locks for a well pump and for pumps continuing to pump when the well is dry.

U.S. Pat. No. 3,295,450 issued on Jan. 3, 1967, to Siegfried Schoenwald et al. describes an electrical control device system for individual water pump installations comprising a control device connected to a pressure-responsive switch for electrically controlling the pump, and comprises a control member responsive to the quantity and velocity of the water passing through the control device for controlling the pressure switch in response to the flow rate.

U.S. Pat. No. 3,318,247 issued on May 9, 1967, to Clyde E. Yost describes an automatic pump control switching device for oil wells and gasoline engines comprising a spring loaded ball and valve system adjustable by screw-thread means. A solenoid valve system is also connected and dependent on the ball and valve system.

U.S. Pat. No. 3,551,620 issued on Dec. 29, 1970, to Jimmie N. Hoover describes a flow, no-flow device which differentiates between gas and liquid flow therethrough. A movable element similar to a valve element and a valve seat remains in the open position for liquids, but closes for gas flow. A switch associated with the movable element interrupts the current flow to a pump motor in a well bore.

U.S. Pat. No. 3,683,137 issued on Aug. 8, 1972, to Marshall A Stiltner describes a pressure switch diaphragm assembly with clamping diaphragm sealing means comprising the actuation of the pressure switch by a pressure responsive diaphragm.

U.S. Pat. No. 3,694,105 issued on Sep. 26, 1972, to Thomas B. Martin describes a system of valves used with a constant-speed pump comprising an adjustable pump by-pass valve and a discharge valve which inactivates the pump motor when discharge pressure exceeds a maximum or falls below a minimum.

U.S. Pat. No. 3,794,789 issued on Feb. 26, 1974, to Johnnie J. Bynum describes a pressure sensitive control for a pump regulator comprising a water pressure switch sensitive to a given lower pressure level below a preset low pressure for disconnecting the electrical circuit.

U.S. Pat. No. 4,200,775 issued on Apr. 29, 1980, to Michael Bodnar describes a pressure responsive switch with a low pressure cutoff comprising a diaphragm exposed to a pressure source and operating a combination of levers to open and close a switch at predetermined pressure values. An element ia provided between the diaphragm and the switch operating means to open the contacts.

U.S. Pat. No. 4,215,254 issued on Jul. 29, 1980, to Nobuyuki Ohki describes a pressure switch with a resiliently mounted contact.

U.S. Pat. No. 5,197,859 issued on Mar. 30, 1993, to Elliot J. Siff describes a well pump system having a sensing device for detecting a parameter correlated to the rate of flow into and out of the pressure tank.

U.S. Pat. No. 5,198,631 issued on Mar. 30, 1993, and U.S. Pat. No. 5,524,333 issued on Jun. 11, 1996, to Ronald L. Hogue et al. describes a pressure responsive control device and method of assembling the device, respectively. The pressure sensitive device has a housing made up of a plurality of housing members, a diaphragm, a bistable snap-disc, a switch, and an actuator.

U.S. Pat. No. 5,725,359 issued on Mar. 10, 1998, to Paul A. Dongo et al. describes a pool pump controller which includes a pneumatic pressure sensor having at least one port disposed to react to negative pressure within a pool's pump intake chamber. The sensor input port, which includes a check valve, is connected to a pump control through a pneumatic tube. The pump control switch combines a diaphragm switch and an opto-interrupter to provide control of the pump motor in a watery environment.

None of the above inventions and patents, taken either singularly or in combination, is seen to describe the instant invention as claimed. Thus a water pump low pressure cutoff switch solving the aforementioned problems is desired.

SUMMARY OF THE INVENTION

The present invention is directed to a low pressure cut-off electric switch for water pumps for home or commercial use with pools, wells, and spa pumps to prevent damage to the pump and motor, and to eliminate fire damage. The electric switch automatically cuts off electrical power to a water pump when the influent water pressure drops below approximately 6 to 8 p.s.i, thereby preventing possible fire and/or damage to the pump. The invention incorporates a by-pass feature for manually overriding the switch. The electric switch comprises a cylindrical metal housing with two electrical wires entering at the bottom to connect to separate contacts protruding at a certain spacing in a first fixed mounting plate. A movable second metal plate holds two contacts at the same certain spacing, and mounts a 6–8 pound compression spring based on the first plate. A rubber diaphragm abuts the second plate to seal water in the upper chamber from entering between the plates. A bypass button in the form of a rod is centered in the second plate and diaphragm and extends to an aperture in the housing and is sealed with a second rubber seal. The bypass button serves to temporarily test the electrical connection by pushing the contacts together. Also, the by-pass button closes the contacts to prime the water pump when the water pressure is between 6–8 psi.

A water inlet and outlet pipe is positioned on the side of the housing between the second metal plate and the top of the housing. At normal water pressure in the switch, the contacts are joined to conduct line current. But when the water pressure in the upper water chamber drops below 6–8 psi, the compression spring pushes the second plate upward to separate the contacts to cut off the electrical circuit to the water pump.

Accordingly, it is a principal object of the invention to provide an automatic low pressure cut-off switch to prevent a water pump from operating when a low water pressure is detected.

It is another object of the invention to provide a cylindrical, automatic, low pressure cut-off switch housing having a lower dry chamber having a first pair of electrical contacts supported by a fixed first plate for contacting an upper matching second pair of electrical contacts.

It is a further object of the invention to provide an automatic low pressure cut-off switch having a water containing chamber defined by a housing and a diaphragm, the diaphragm abutting a movable plate having switch contacts, a compression spring biasing the movable plate away from a fixed plate bearing switch contacts, in which water pressure in the water containing chamber overcomes the bias of the compression spring to close the switch contacts, but in which the compression spring forces the switch contacts to an open position when water pressure falls below a predetermined limit defined by the spring constant.

Yet another object of the invention is to provide an automatic low pressure cut-off switch having a second pair of contacts aligned with the first pair of contacts and a centered spring attached to the movable plate and the fixed plate.

Still another object of the invention is to provide an automatic low pressure cut-off switch with a post centered on the movable plate extending outside and acting as a bypass button for temporarily testing the electrical connection.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

The sole FIGURE is a schematic view of a water pump's low pressure cutoff switch according to the present invention.

DETAILED DESCRIPTION OF THE PREFERRED EMBODIMENT

The present invention is directed to low pressure cut-off switch device for a water pump to prevent damage to the water pump when the water pressure is below approximately 6 to 8 psi. The switch device can be connected to any part of the water line passing from the pump to a well and the like.

The switch device 10 is shown in the Figure as having an enclosed housing 12 with water 14 entering through a pipe 16, e.g., a quarter inch pipe, threaded and affixed by a nut 18 to the upper chamber 20. The upper chamber 20 is defined by the housing 12 and a flexible, water impermeable diaphragm 26, e.g., a rubber diaphragm, affixed to the sidewall 24 of the housing 12. A movable plate 22 is disposed below the diaphragm and abuts the housing sidewall 24. Alternatively, the rubber diaphragm 26 may be fixed to the top surface of movable plate 22 by adhesive, the rubber seal extending against the sidewall 24 to prevent water entering the lower chamber 40, as the plate 22 moves up and down. A post 28 extends through the diaphragm 26 and is affixed to the movable plate 22. The post 28 extends through an aperture 30 in the top cover or upper wall 32 of the housing 12, and into a rubber seal 34 for use as a bypass button 36. Two spaced cylindrical metal contacts 38 with flat faces are attached to the bottom surface of the movable plate 22. The contacts on the bottom surface of the movable plate are electrically connected to each other, as by making the movable plate 22 from metal, but are electrically insulated from compression spring 48 and fixed plate 42.

A lower dry chamber 40 is defined between the diaphragm 26 and a bottom wall of the housing 12 and has a fixed plate 42 disposed therein, the fixed plate 42 having apertures 44 for positioning a second pair of cylindrical metal contacts 38 with flat faces through the apertures 44 to align with the upper button contacts 38. The contacts 38 on the movable plate 22 and the contacts 38 on the fixed plate 42 have equal flat contacting areas which insure maximum reliability over time, and are connected to electrical wires 46. The wires 46 are rated at 115 to 230 volts A.C. An helical compression spring 48 having a spring constant selected so that spring 48 expands when the water pressure in the upper chamber 20 has decreased to approximately 6 to 8 psi is attached to both the movable plate 22 and the fixed plate 42.

The bypass button 36 is useful in determining whether the device 10 is operating correctly, and whether electricity is flowing from the power source to the pump, since pressing the bypass button 36 with sufficient force will compress spring 48 to close the contacts 38 and energize the pump, even though water pressure has fallen below 6–8 p.s.i.

Thus, when the water pressure in the system including a water pump (not shown) decreases below the calibrated value of the switch device 10, the compression spring 48 expands to separate the switch contacts 38, and shut off the electricity powering the water pump. This switch device 10 is simple in construction and reliable in use in protecting expensive water pumps from damage due to low water pressures in the system.

Although the device has been described in a certain position, it can be attached to the water pipeline in any position and still be effective.

It is to be understood that the present invention is not limited to the embodiment described above, but encompasses any and all embodiments within the scope of the following claims.

I claim:

1. A water pump low pressure cutoff switch device comprising:

a housing having an upper wall, a bottom wall, and at least one sidewall;

a flexible, water impermeable diaphragm attached to the at least one sidewall of said housing and defining an upper chamber and a lower chamber;

a movable plate disposed in said lower chamber abutting said diaphragm and having a first pair of switch contacts separated a predetermined distance apart on a lower surface of said movable plate;

a fixed plate affixed to the sidewall below said movable plate, and having a second pair of switch contacts on its upper surface aligned with the pair of electrical contacts on said movable plate;

wiring connected to said second pair of switch contacts and connecting said second pair of switch contacts in series with a water pump;

a compression spring affixed to the first circular plate and to the second circular plate; and a water inlet and outlet line connected to said upper chamber;

wherein pressure exerted by water against said diaphragm maintains said first and second switch contacts in a closed position, and wherein said compression spring expands when pressure exerted by water falls below at a predetermined value in order to move said first and second switch contacts to an open position in order to cut off electrical power to the water pump.

2. The water pump low pressure cutoff switch according to claim 1, wherein said diaphragm is made from rubber.

3. The water pump low pressure cutoff switch according to claim 1, wherein said second pair of switch contacts extend above and below said fixed plate.

4. The water pump low pressure cutoff switch according to claim 1, wherein said first and second pairs of switch contacts have flat contacting surfaces that are equal in area.

5. The water pump low pressure cutoff switch according to claim 1, further comprising an upright post attached to said movable plate and extending through said diaphragm and through an aperture defined in the upper wall of said housing.

6. The water pump low pressure cutoff switch according to claim 5, further comprising a rubber seal disposed over the aperture defined in the upper wall of said housing, said post extending into said rubber seal and defining a bypass button.

7. The water pump low pressure cutoff switch according to claim 1, wherein said compression spring has a spring constant which causes said first and second switch contacts to move to an open position when water pressure in the upper chamber falls below a pressure in a range of 6 to 8 p.s.i.

8. The water pump low pressure cutoff switch according to claim 1, wherein the switch operates at a range of 115–230 volts A.C.

* * * * *